US005358105A

United States Patent [19]

Boriani et al.

[11] Patent Number: 5,358,105

[45] Date of Patent: Oct. 25, 1994

[54] RIGID PACKAGE, PARTICULARLY FOR CIGARETTES

[75] Inventors: Silvano Boriani; Antonio Gamberini, both of Bologna, Italy

[73] Assignee: G.D Societa' per Azioni, Bologna, Italy

[21] Appl. No.: 186,659

[22] Filed: Jan. 25, 1994

[30] Foreign Application Priority Data

Feb. 3, 1993 [IT] Italy ..... BO93 A 000030

[51] Int. Cl.[5] ..... B65D 85/10

[52] U.S. Cl. ..... 206/268; 206/264; 206/273

[58] Field of Search ..... 206/264, 265, 273

[56] References Cited

U.S. PATENT DOCUMENTS

| | | | |
|---|---|---|---|
| 2,367,476 | 1/1945 | Tyrseck | 206/268 X |
| 2,872,097 | 2/1959 | Graybill | 206/268 X |
| 4,729,508 | 3/1988 | Erdmann et al. | 206/273 X |

*Primary Examiner*—William I. Price

*Attorney, Agent, or Firm*—Marshall, O'Toole, Gerstein, Murray & Borun

[57] ABSTRACT

A rigid package, particularly for cigarettes, substantially in the form of a rectangular prism and defined by a cup-shaped body having, at the open end, a collar and a lid hinged to the rear edge of the cup-shaped body; the package being formed from a blank incorporating the collar, and wherein a central panel with lateral tabs defines the front wall of the package, and presents, together with the tabs, a precut line for detaching the front edge and lateral edges of the lid from corresponding edges of the cup-shaped body.

10 Claims, 5 Drawing Sheets

RIGID PACKAGE, PARTICULARLY FOR CIGARETTES

BACKGROUND OF THE INVENTION

The present invention relates to a rigid package, particularly for cigarettes.

In the following description, the term "package" is used indifferently to indicate the packaging of both a carton and a single packet of cigarettes.

SUMMARY OF THE INVENTION

It is an object of the present invention to provide a package of the aforementioned type which may be produced from a straightforward, low-cost blank, and is both practical and attractive in appearance.

According to the present invention, there is provided a rigid package, particularly for cigarettes, comprising a cup-shaped body with an open end defined by a first rear edge, a first front edge, and first lateral end edges of the cup-shaped body; a collar housed partly inside the cup-shaped body; and a lid having a second front edge, second lateral edges, and a second rear edge connected to the first rear edge and defining, with the first rear edge, a hinge connecting the lid and the cup-shaped body; characterized by the fact that it is formed from a blank wherein preformed bend lines define a central panel having lateral tabs and in turn defining the front wall of the package; and a first and second peripheral panel on either side of the central panel and in turn respectively defining the rear wall of the package and the collar; the second panel being folded on to the inner surface of the central panel; and the central panel and relative tabs presenting a precut ripoff line for detaching said second lateral edges and said second front edge from said first lateral edges and said first front edge.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
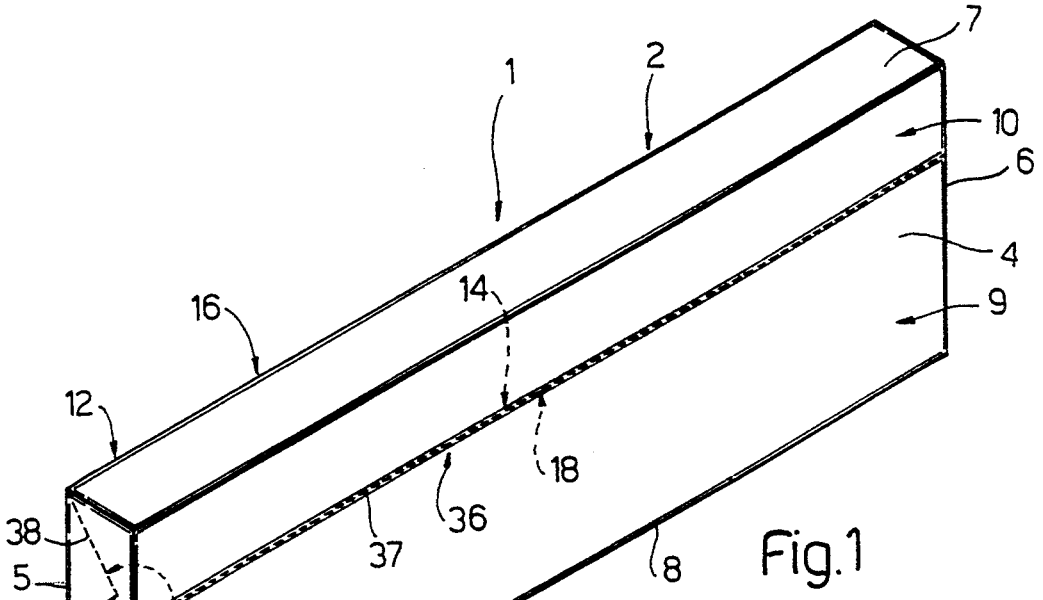
FIG. 1 shows a view in perspective of a first preferred embodiment of the package according to the present invention and in the closed position.
Figure 2:
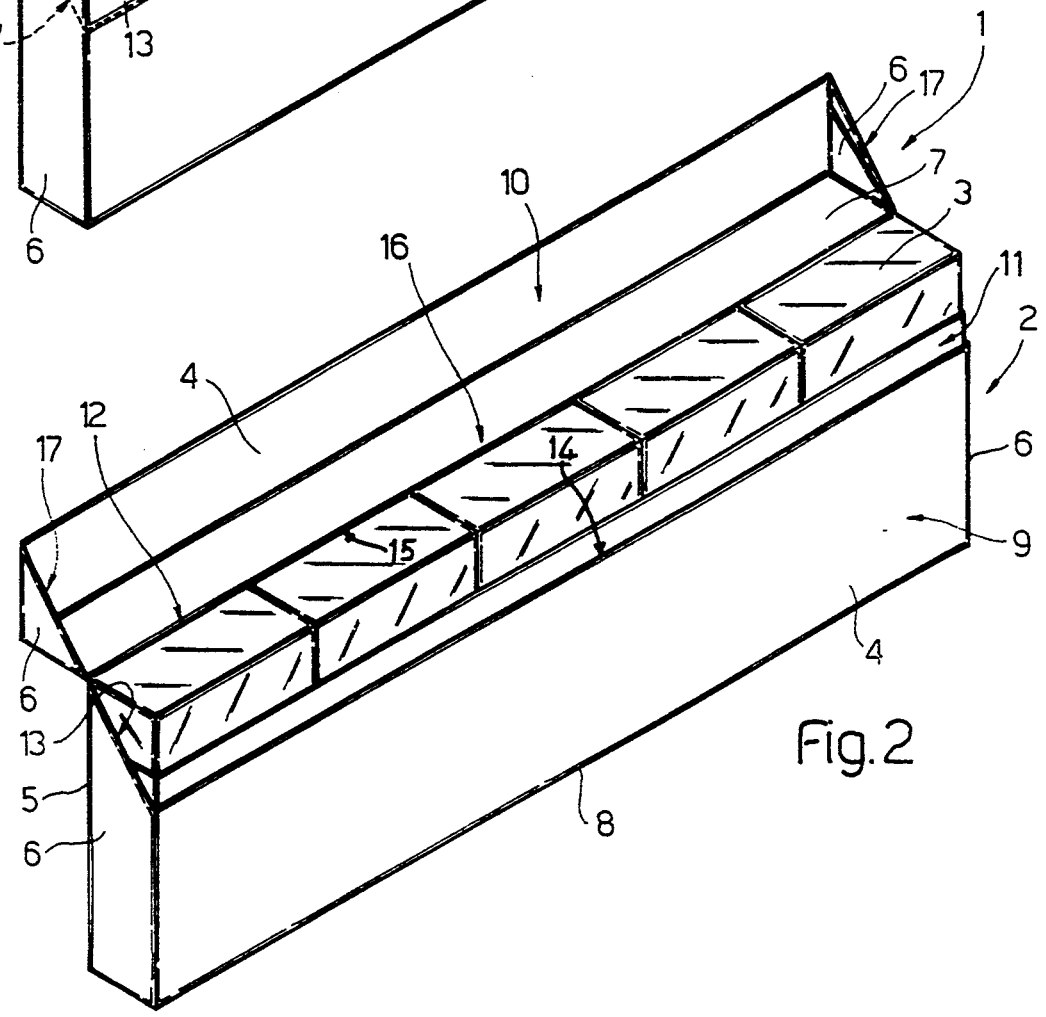
FIG. 2 shows a view in perspective of the FIG. 1 package in the open position.
Figure 3:
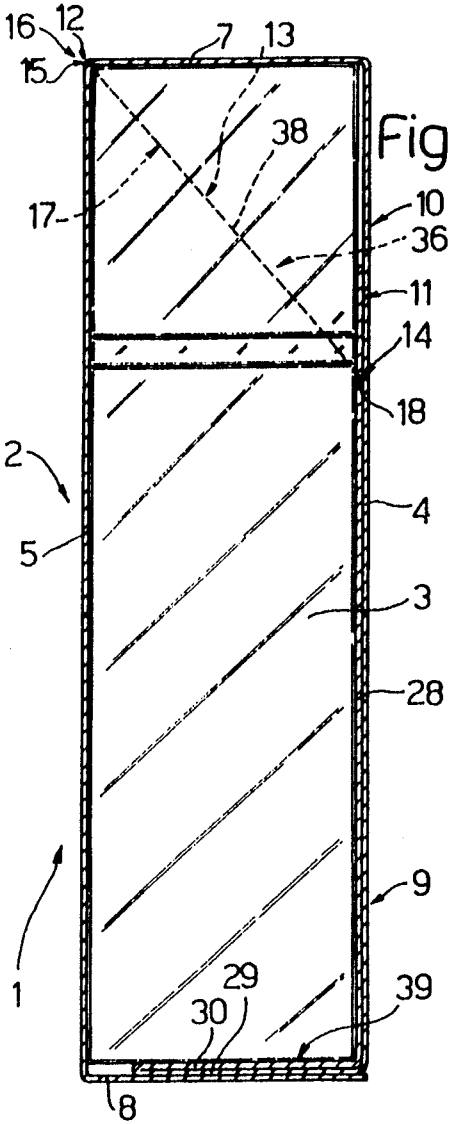
FIG. 3 shows a cross section of the FIG. 1 package.

Number 1 in FIGS. 1, 2 and 3 indicates a cigarette carton comprising a rigid, hinged-lid outer package 2, and a number of packets 3 of cigarettes housed inside package 2.

Package 2 presents a front wall 4 and rear wall 5 parallel to and facing each other; two lateral walls 6 parallel to each other and perpendicular to walls 4 and 5; a top wall 7 and bottom wall 8 parallel to each other and perpendicular to walls 4, 5 and 6; and comprises a bottom cup-shaped body 9; a top lid 10 closing body 9; and a collar 11 (FIG. 2) housed inside body 9 and projecting frontwards and laterally from the open top end of body 9.

As shown in FIG. 2, the open top end of body 9 is defined by a rear edge 12 extending along the top edge of wall 5; two inclined lateral edges 13 extending obliquely along respective walls 6; and a front edge 14 below edge 12 and extending across a top portion of wall 4. Similarly, lid 10 presents an open bottom end defined by a rear edge 15 coincident with edge 12 and defining, with edge 12, a hinge 16 connecting lid 10 and body 9; two inclined lateral edges 17 contacting edges 13 when lid 10 is closed as shown in FIG. 1; and a front edge 18 contacting edge 14 when lid 10 is closed.

Figure 4:
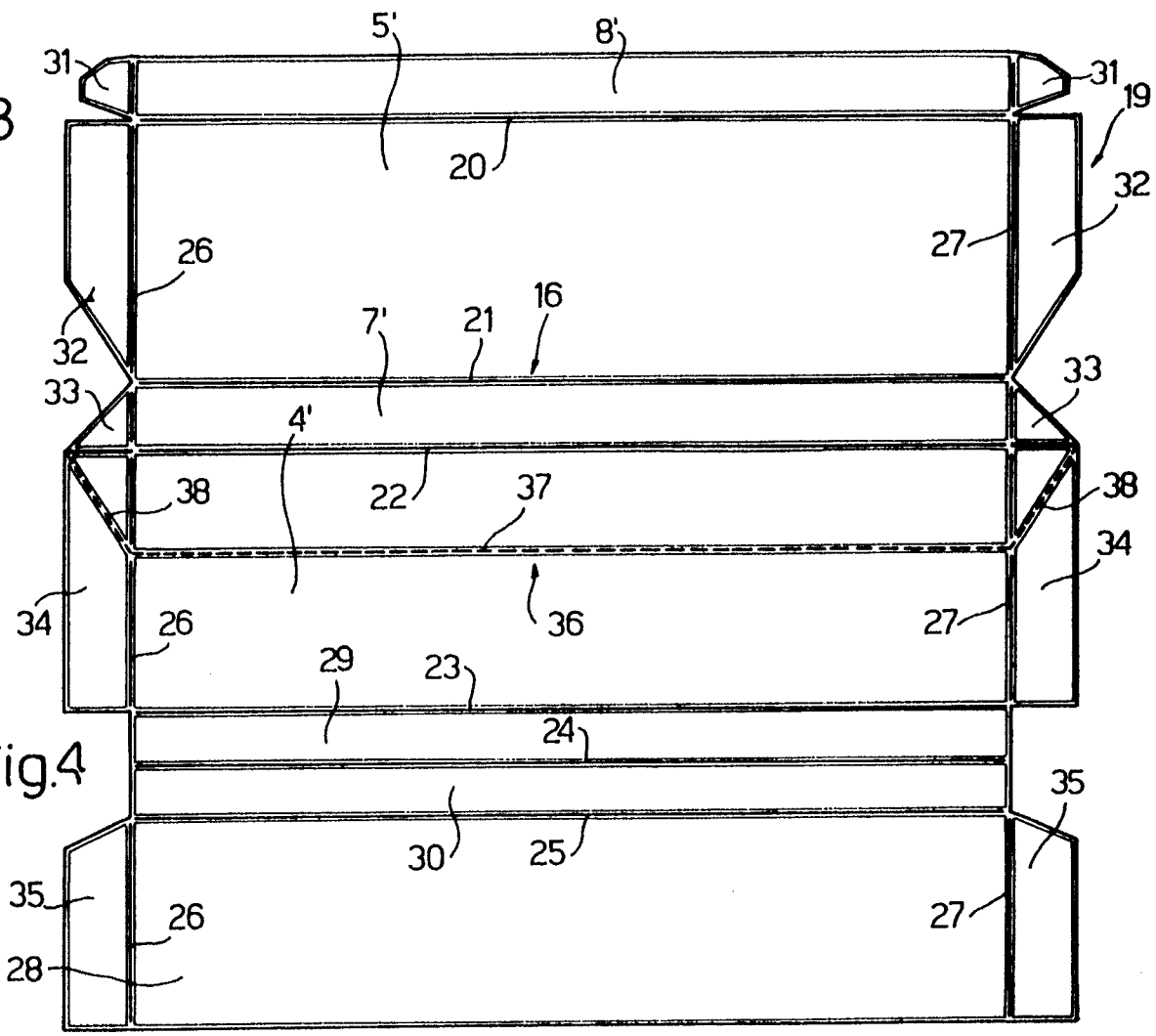
FIG. 4 shows the blank of the FIG. 1 package.

As shown in FIG. 4, package 2 is formed, by way of example, from a flat, substantially elongated rectangular blank 19, the component parts of which, where possible, will be indicated using the same reference numbers, plus a (′), as for the corresponding parts of package 2.

Blank 19 presents a number of preformed transverse bend lines 20, 21, 22, 23, 24, 25, and two preformed longitudinal bend lines 26, 27.

Line 21 defines hinge 16, and, between lines 26 and 27 and together with the other transverse lines, defines a transverse end panel 8′; a first peripheral panel 5′; a central panel 4′ separated from panel 5′ by a low panel 7′ of the same height as panel 8′; and a second peripheral panel 28 on the opposite side of panel 4′ to panel 5′ and shorter in height than panel 4′. Panel 28 is separated from panel 4′ by two connecting panels 29 and 30 defined by lines 23, 24 and 25 and of the same height as each other but shorter in height than panel 7′. Outwards of transverse lines 20–25, each longitudinal line 26, 27 defines tabs 31, 32, 33, 34 and 35 extending laterally outwards from respective panels 8′, 5′, 7′, 4′ and 28.

Finally, across panel 4′ and tabs 34, there is formed a precut ripoff line 36 comprising a central portion 37 extending across panel 4′ parallel to lines 20–25 and between lines 26 and 27 to define edges 14 and 18; and two oblique portions 38, each extending across a respective tab 34 to define a respective edge 13 and a respective edge 17.

The manner in which blank 19 is folded to form package 2 is clearly discernible in FIGS. 3 and 4: panel 28 is folded forward (in relation to the FIG. 4 plane) 90° about line 25; panel 30 is folded backward 180° about line 24 and on to panel 29; and panel 29 is folded backward 90° about line 23 so as to define, together with panel 30, an inner strengthening element 39 perpendicular to panel 4′, and so that panel 28 and tabs 35 contact a rear surface portion of panel 4′ and tabs 34 to define collar 11. Package 2 is then completed by folding panels 7′, 5′ and 8′ backward 90° about respective lines 22, 21 and 20, and by gumming panel 8′ on to element 39. Similarly, tabs 31, 32, 33 and 34 are folded backward 90° about respective lines 26, 27, and connected one on top of the other to define the two lateral walls 6. As shown in FIG. 4, each tab 32 is obviously so formed that, on contacting the inner surface of respective tab 34, it coincides with the portion of tab 34 beneath respective portion 38 of line 36.

In actual use, each blank 19 is folded as described above about a respective group of packets 3 to form a respective carton 1, the package 2 of which is opened for removing packets 3 by simply tearing it along line 36 and so defining body 9 and lid 10. The built-in collar 11 of package 2 enables lid 10 to be closed and secured by friction in the closed position following removal of one or more packets 3.

Figure 6:
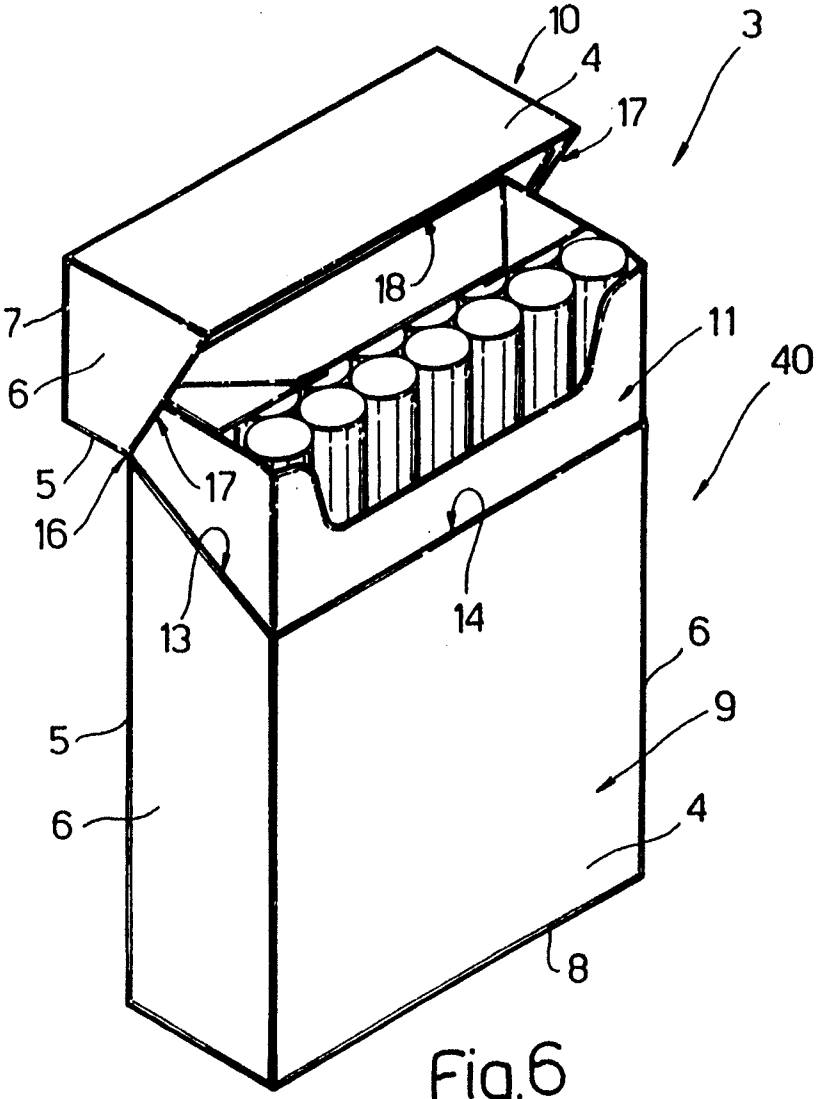
FIG. 6 shows a view in perspective of the FIG. 5 package in the open position.
Figure 5:
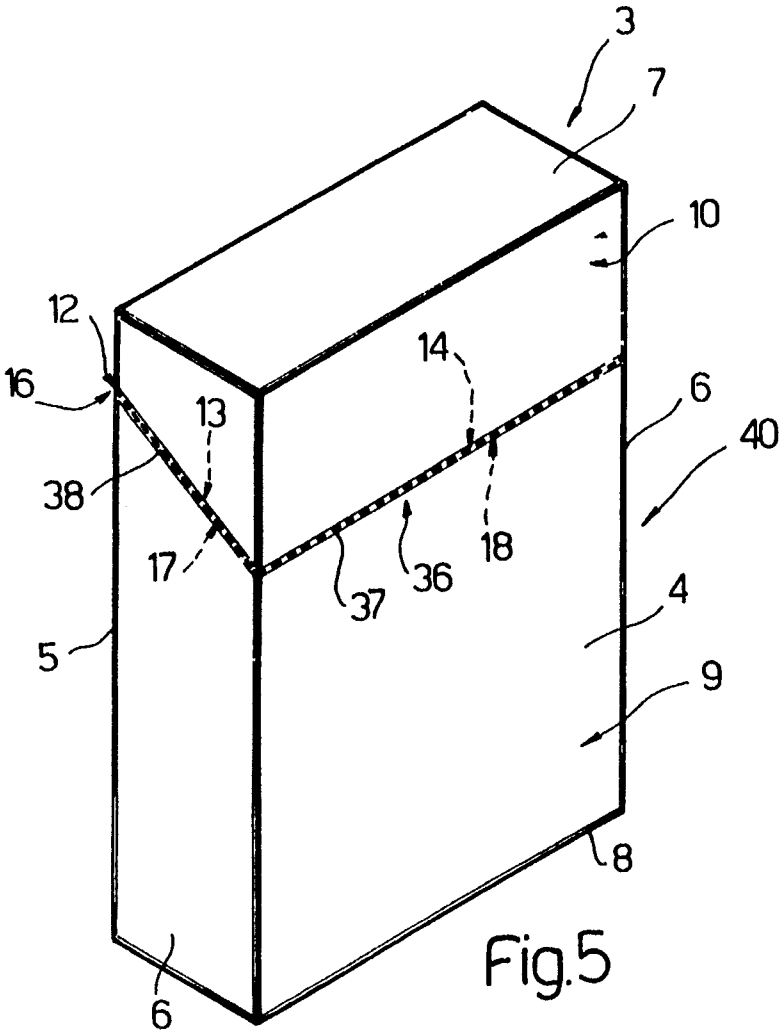
FIG. 5 shows a view in perspective of a second preferred embodiment of the package according to the present invention and in the closed position.
Figure 7:
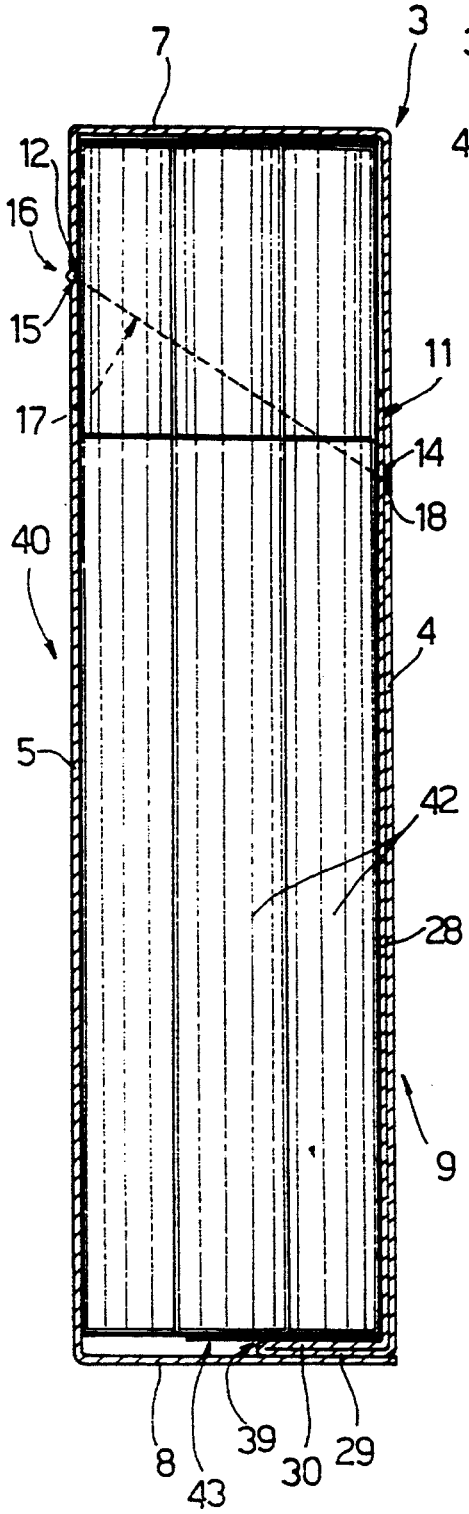
FIG. 7 shows a cross section of the FIG. 5 package.
Figure 8:
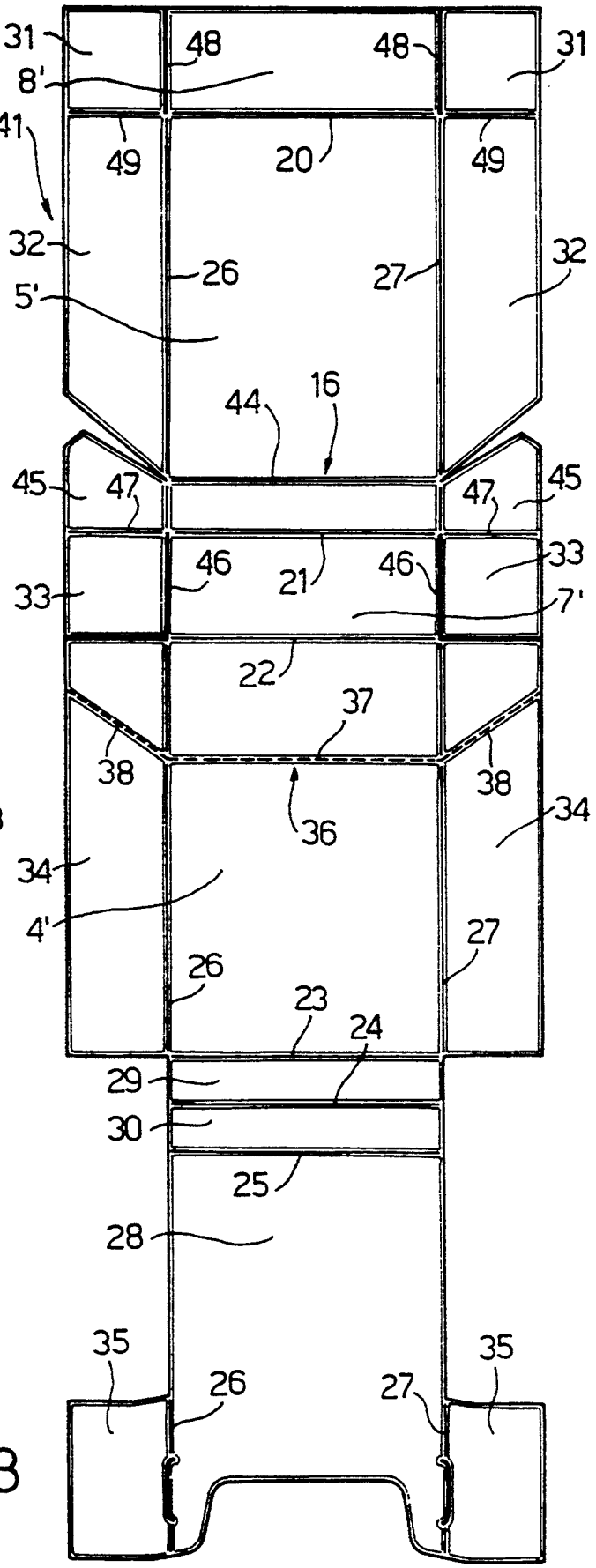
FIG. 8 shows the blank of the FIG. 5 package.

FIGS. 5, 6 and 7 show a packet 3 of cigarettes comprising a rigid, hinged-lid outer package 40 formed by folding blank 41 in FIG. 8; and a number of cigarettes 42 wrapped in a sheet 43 of foil and housed inside package 40.

From the design standpoint, package 40 and blank 41 are substantially similar to package 2 and blank 19, the component parts of which will therefore be indicated wherever possible using the same numbering system.

As can be seen, the only structural difference between packages 2 and 40 is that, as opposed to coinciding with the top edge of rear wall 5, hinge 16 of package 40 is located below the top edge of wall 5 but in any case higher than edge 14.

To enable the above location of hinge 16, panel 5' of blank 41 presents a further transverse bend line 44 adjacent to line 21.

As compared with blank 19, tabs 35 of panel 28 of blank 41 extend solely along the end portion of panel 28; tabs 32 terminate at line 44; the portion of panel 5' extending between lines 44 and 21 presents further tabs 45; each tab 33 is detached from panel 7' by an incision 46 extending along line 26, 27, and is integral with respective tab 45 along a bend line 47 constituting an extension of line 21; and each tab 31 is detached from panel 8' by an incision 48 extending along line 26, 27, and is integral with respective tab 32 along a bend line 49 constituting an extension of line 20.

Needless to say, all the above modifications may also be made to blank 19 for producing packages 2 wherein lid 10 rotates about a hinge 16 located below the top edge of rear wall 5.

Figure 9:
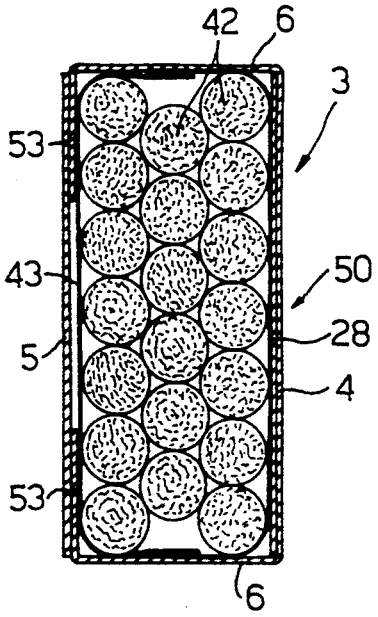
FIG. 9 shows a cross section of a variation of the FIG. 5 package.
Figure 10:
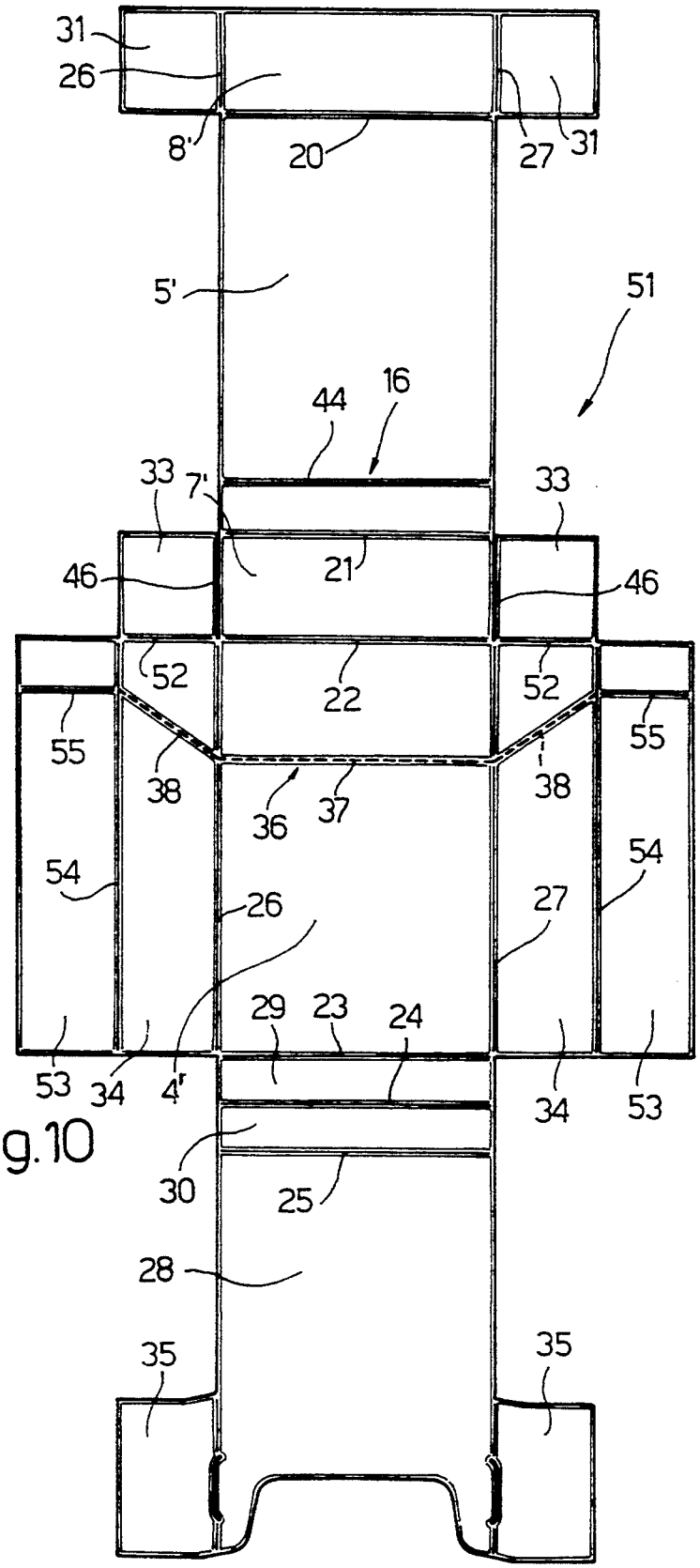
FIG. 10 shows the blank of the FIG. 9 package.

The FIG. 9 variation relates to a packet 3 of cigarettes comprising a rigid, hinged-lid outer package 50 formed by folding blank 51 in FIG. 10.

From the design standpoint, package 50 and blank 51 are substantially similar to package 40 and blank 41, the component parts of which will therefore be indicated wherever possible using the same numbering system.

As compared with blank 41, panel 5' of blank 51 presents no lateral tabs; tabs 31 are connected to panel 8' along lines 26 and 27; tabs 33 are connected to respective tabs 34 along respective bend lines 52, each constituting an extension of line 22; and a further longitudinal tab 53 is provided outwards of each tab 34, and is connected to tab 34 along a respective longitudinal bend line 54 outwards of and parallel to line 26, 27.

Tabs 34 of blank 51 alone define lateral walls 6 of package 50, unlike packages 2 and 40 in which walls 6 are defined by two superimposed longitudinal tabs. Both packages 2 and 40 may of course be modified as shown in FIGS. 9 and 10 wherein (FIG. 9) 90° backward folding of each tab 53 about respective line 54 and in relation to respective tab 34 provides for connecting tab 53 to the inner surface of wall 5' and for laterally closing package 50. As of the adjacent end of respective portion 38 of line 36, each tab 53 obviously presents a bend line 55 which, inside package 50, is superimposed on line 44 with which it defines hinge 16.

The main advantage of blank 51 as compared with 41 is that, by eliminating tabs 32 of blank 41 and substituting tabs 53, the central or intermediate portion of blank 51 is no longer traversed end to end by ripoff line 36 as in blank 41, but presents two integral outer tabs 53 for preventing blank 51 from being inadvertently torn in half along line 36.

We claim:

1. A rigid package (2; 40; 50), particularly for cigarettes, comprising a cup-shaped body (9) with an open end defined by a first rear edge (12), a first front edge (14), and first lateral end edges (13) of the cup-shaped body (9); a collar (11) housed partly inside the cup-shaped body (9); and a lid (10) having a second front edge (18), second lateral edges (17), and a second rear edge (15) connected to the first rear edge (12) and defining, with the first rear edge (12), a hinge (16) connecting the lid (10) and the cup-shaped body (9); characterized by the fact that it is formed from a blank (19; 41; 51) wherein preformed bend lines (20–27) define a central panel (4') having lateral tabs (34) and in turn defining the front wall (4) of the package (2; 40; 50); and a first (5') and second (28) peripheral panel on either side of the central panel (4') and in turn respectively defining the rear wall (5) of the package (2; 40; 50) and the collar (11); the second panel (28) being folded on to the inner surface of the central panel (4'); and the central panel (4') and relative tabs (34) presenting a precut ripoff line (36) for detaching said second lateral edges (17) and said second front edge (18) from said first lateral edges (13) and said first front edge (14).

2. A package (2; 40; 50) as claimed in claim 1, characterized by the fact that the blank (19; 41; 51) comprises two connecting panels (29, 30) adjacent to each other and interposed in series between the central panel (4') and the second peripheral panel (28); said two connecting panels (29, 30) being folded one on to the other and constituting a strengthening element (39) for the bottom wall (8) of said cup-shaped body (9).

3. A package (2) as claimed in claim 1, characterized by the fact that said precut line (36) presents opposite ends coinciding with corresponding ends of said hinge (16).

4. A package (2) as claimed in claim 1,
characterized by the fact that said hinge (16) coincides with the top edge of the rear wall (5) of the package (2).

5. A package (40; 50) as claimed in claim 1,
characterized by the fact that said hinge (16) extends across the top portion of the rear wall (5) of the package (40; 50); said first peripheral panel (5') presenting a preformed intermediate transverse bend line (44) defining said hinge (16).

6. A package (2; 40) as claimed in claim 1,
characterized by the fact that said first peripheral panel (5') presents lateral tabs (32); the tabs (34, 32) of the central panel (4') and of the first peripheral panel (5') being folded towards one another and superimposed to define the two lateral walls (6) of the package (2; 40).

7. A package (50) as claimed in claim 1,
characterized by the fact that the lateral tabs (34) of the central panel (4') are folded to define respective lateral walls (6) of the package (50); each lateral tab (34) presenting a respective outer tab (53) which is folded on to the rear wall (5) of the package (50) defined by said first peripheral panel (5'), for connecting together said lateral walls (6) and said rear wall (5).

8. A package (50) as claimed in claim 7,
characterized by the fact that said outer tabs (53) are continuous and without said precut ripoff line (36).

9. A package (2) as claimed in claim 1,
characterized by the fact that it is a package (2) for a carton (1) of cigarettes.

10. A package (40; 50) as claimed in claim 1,
characterized by the fact that it is a package (40; 50) for a packet (3) of cigarettes.

* * * * *